US007121621B1

(12) United States Patent
Starheim et al.

(10) Patent No.: US 7,121,621 B1
(45) Date of Patent: Oct. 17, 2006

(54) INFORMATION PLACARD HOLDER FOR A STADIUM SEAT

(76) Inventors: Scot A Starheim, 2674 N. Woodfield Dr., Wasilla, AK (US) 99654; Bruce Douglas Ross, 2749 45th Ave. SW., Seattle, WA (US) 98116

( * ) Notice: Subject to any disclaimer, the term of this patent is extended or adjusted under 35 U.S.C. 154(b) by 0 days.

(21) Appl. No.: 11/098,805

(22) Filed: Apr. 4, 2005

(51) Int. Cl.

| | |
|---|---|
| ***A47C 7/62*** | (2006.01) |
| ***A47C 31/11*** | (2006.01) |
| ***G09F 3/18*** | (2006.01) |
| ***G09F 3/20*** | (2006.01) |
| ***G09F 7/04*** | (2006.01) |

(52) U.S. Cl. ..... 297/188.04; 297/188.06; 297/188.07; 297/228.1; 297/228.11; 297/228.12; 40/320; 40/600

(58) Field of Classification Search ..... 297/228.1, 297/228.11, 228.12, 188.04, 188.06, 188.07; 40/320, 606.08, 611.06, 600
See application file for complete search history.

(56) References Cited

U.S. PATENT DOCUMENTS

| | | | | |
|---|---|---|---|---|
| 508,046 | A * | 11/1893 | Partridge | 40/320 X |
| 1,304,753 | A * | 5/1919 | Dwyer | 297/228.11 X |
| 1,550,068 | A * | 8/1925 | Golden | 40/320 |
| 1,612,574 | A * | 12/1926 | Golden | 40/320 |
| 2,056,767 | A * | 10/1936 | Blath | 297/228.12 X |
| 2,517,433 | A * | 8/1950 | Hoven et al. | 40/320 X |
| 2,770,903 | A * | 11/1956 | Schmidt | 40/320 |
| 3,187,449 | A * | 6/1965 | Longo et al. | 40/600 X |
| 3,237,327 | A * | 3/1966 | Griggs | 40/600 X |
| 4,310,978 | A * | 1/1982 | Stern | 40/600 |
| 4,597,605 | A * | 7/1986 | Gilbert | 297/188.06 X |
| 4,785,562 | A * | 11/1988 | Good | 40/600 X |
| 5,248,536 | A | 9/1993 | Du Katz | |
| 5,274,937 | A * | 1/1994 | Birnbaum | 40/600 |
| 5,707,107 | A * | 1/1998 | Melone | 297/228.1 |
| 5,720,515 | A * | 2/1998 | Haffner | 40/320 X |
| 6,006,462 | A * | 12/1999 | Lackomar | 297/188.06 X |
| 6,174,082 | B1 | 1/2001 | Pelky et al. | |
| 6,393,748 | B1 * | 5/2002 | Cooper | 40/610 |
| 6,484,428 | B1 * | 11/2002 | Greenwald et al. | 40/600 |
| 6,588,840 | B1 * | 7/2003 | Lombardo | 297/228.12 |
| 6,601,913 | B1 * | 8/2003 | Romca et al. | 40/320 X |
| 6,705,334 | B1 * | 3/2004 | Altobelli | 40/320 X |
| 6,899,391 | B1 * | 5/2005 | Schneller et al. | 297/228.1 X |
| 6,908,653 | B1 * | 6/2005 | Keane | 40/453 |
| 2002/0047294 | A1 * | 4/2002 | Ellinidis et al. | 297/188.04 |
| 2002/0074839 | A1 * | 6/2002 | Mahan | 297/228.1 |
| 2002/0116846 | A1 * | 8/2002 | Wu | 40/320 |
| 2003/0019136 | A1 * | 1/2003 | Whitman | 40/320 |
| 2004/0251720 | A1 * | 12/2004 | Micheletti | 297/228.1 |
| 2005/0115126 | A1 * | 6/2005 | Rampen et al. | 40/781 |

* cited by examiner

*Primary Examiner*—Rodney B. White

(57) ABSTRACT

A flexible panel having an window aperture with a clear covering and a cooperating pocket behind the window for holding an information containing placard. One embodiment utilizes a magnetic frame for attachment to a surface. Another embodiment uses an angled bracket attached to a stadium seat to tilt the placard toward the viewer in the seat behind.

9 Claims, 3 Drawing Sheets

INFORMATION PLACARD HOLDER FOR A STADIUM SEAT

RELATED APPLICATIONS

None

U.S. GOVERNMENT INTEREST IN THE INVENTION

None

BACKGROUND OF THE INVENTION

1. Field of the Invention

Holder for replaceable signage attached to the back of a chair or seat.

2. Description of Related Art

The backs of loose chairs or fixed seating used in group settings such as arenas, stadiums, convention meeting rooms, theaters, restaurants and the like are ideal surfaces for attaching informational placards for advertising, seat assignment, instructions, entertainment and the like to an audience that will be present long enough to read and digest the information presented. Since such an audience may also have time on their hands, become bored, etc, the placard must be contained in a reasonably vandal resistant holder and be replaceable at low cost, both for refreshing the message, and replacing vandalized holders.

In many venues, the attachment must not leave any residue such as glue or holes in the seat back.

Because the seat backs in many installations lean backwards a few degrees, a sign on the back should be offset to be at least vertical, or preferably, slightly upwardly facing to provide a more normal view for reading.

U.S. Pat. No. 6,174,082, by Miles Pelky, et al, describes a satchel having an open pocket for retaining an advertising panel (FIGS. 6–61 and Col 3 L38–51), and a second pocket 42 for slipping over the back of a chair. The overall function and purpose of Mr. Pelky's invention differs from the present invention. The present invention is intended to have a greater permanence and Mr. Pelky's display pocket is totally unprotected from being tampered with, as his application needs no such protection.

Mr. Pelky's invention is not intended to remain on the chair after occupation. It is to be removed and used as a carrying case (satchel or briefcase like) for convention handouts.

U.S. Pat. No. 5,248,536 by Eugene Du Katz is a laminated structure designed for adhesively attaching to a flat surface for relatively long periods of time. It is suitable only for flat surfaces unless special assembly procedures are employed. Even then it is not suitable for compound curved surfaces. Mr Du Katz placard is laminated using adhesives that permit disassembly. Such adhesives may need refreshing prior to re-assembly. That would be unwieldy high labor to do in the stands of an arena, so re-placing the indicia may require removal to a work shop area. Furthermore, Mr Du Katz placard is glued to the mounting surface. Again, there is the problem of residual glue on the mounting surface and refreshment of the adhesive. Removing any residual glue may require solvents, which would be unsatisfactory in the quantity needed for arena seat washing. Furthermore, the solvent may attack the paint on the seat. Mr. Du Katz intends his invention to be used on restaurant counter tops and similar places. Solvents might be needed to clean up the residual adhesives, but seldom and in small quantities. Also, counter tops are usually made of extremely durable non-painted surfaces such as Formica, glass, or ceramics which are resistant to common solvents and gentle scraping.

For arena and stadium use, his placard is a ready target for vandalism, and may also pick up ugly dirt around the exposed glue at the perimeter.

3. Objects of the Invention

It is an object of the present invention to provide a holder for a replaceable placard viewable to the person seated behind a chair or seat in a stadium, arena, or other group setting.

It is another object of the present invention to have the placard as vandal resistant as is practical in view of economic constraints on its construction and installation.

It is another object of the present invention to permit economical changing of the informational placard.

It is another object of the present invention to have alternative embodiments in the details of the construction and use of the disclosed invention also be included within the scope of the claims.

It is another object of the present invention to be capable of holding placards of substantial thickness, thereby permitting the use of holographic, dual image displays, and diffraction displays in which the viewed image changes with the angle of viewing or the quality of ambient lighting.

These objects and others will fulfilled by the descriptions of the invention to be presented herein.

BRIEF SUMMARY OF THE INVENTION

A placard displaying system comprising a windowed panel with a placard holding part is integrally assembled with a means to affix a placard display to a seat of the kinds commonly found in stadiums, arenas, and meeting places is disclosed herein. The seat may be either fixed to the floor or portable.

Since some of the intended venues have seats in rows with people seated behind in close proximity, the display system must also include reasonable protection from vandalism and be both replaceable and changeable with minimal labor and material costs.

Accordingly, the disclosed invention is comprising a bag-like sleeve that fits over the back of a seat. One side of the bag has a paned window behind which an informational placard is placed. An internal second panel is secured behind the window thus forming a pocket into which an information containing placard is placed. Other areas of the bag surface including the front and sides may be inscribed with permanent logos, art-work, or information.

One use for the opposite side (seat side) of the bag from the window is to have a solid color to be used as pixels for large scale decoration. Zones of seating would be fitted with various colors so that from across the arena, the seat colors blend to form an image.

A second "color" of fluorescent paint could be used to cause the image to change under illumination with UV light and/or be visible in a darkened arena.

A reflective material could be used to cause the seats to "light-up" on command of the master of ceremonies.

Other embodiments of the basic placard holder are described.

TABLE OF DETAILED COMPONENTS OF THE INVENTION

Figure 2:
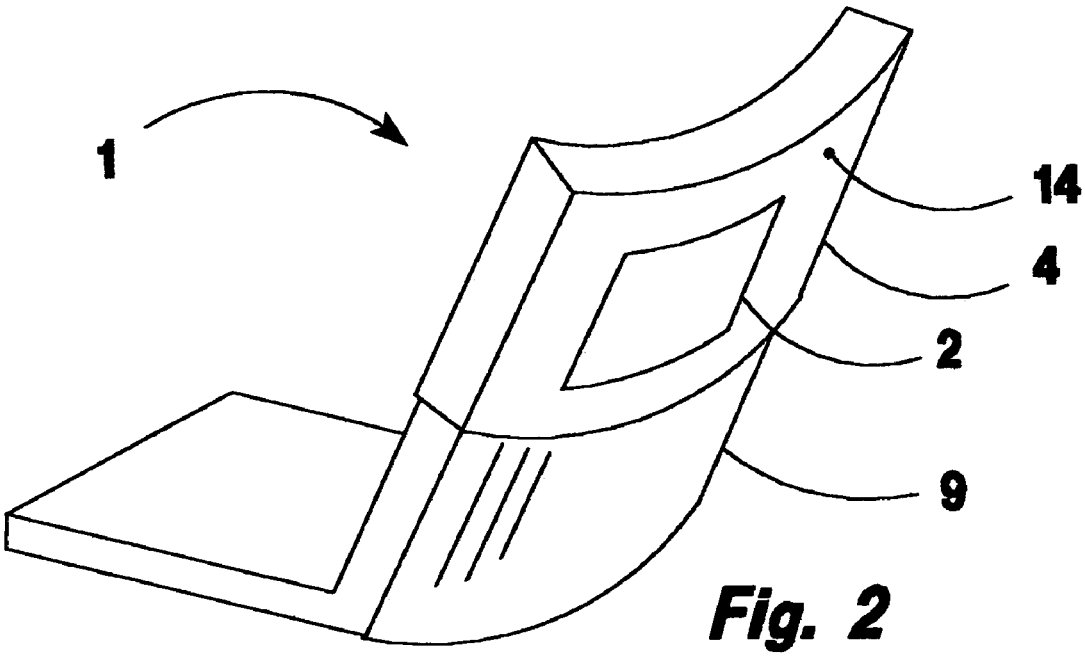
FIG. 2 A seat with the easy-view embodiment of the invention installed

1. A seat with the invention installed
2. Window with transparent glazing
3. Tilted placard holder
4. Slip cover with display window
5. Interior panel forming a pocket
6. Alternative permanent inscribing
7. Flexible panel placard holder
8. Front side decoration of surface the mounted embodiment
9. Arena seat or chair
10. Side and top panels of the chair embodiment
11. Not used
12. Front panel of surface the mounted embodiment
13. Hinge
14. Panel with window
15. Panel fastening bollard
16. Panel fastening button
17. Panel fastening screw and washer
18. Fastening loop
19. Welding zone between panels 14 and 5
20. Mounting or Hold-down/locking fasteners (typical locations)
21. Angled mounting bracket.

DETAILED DESCRIPTION OF THE INVENTION

Figure 3:
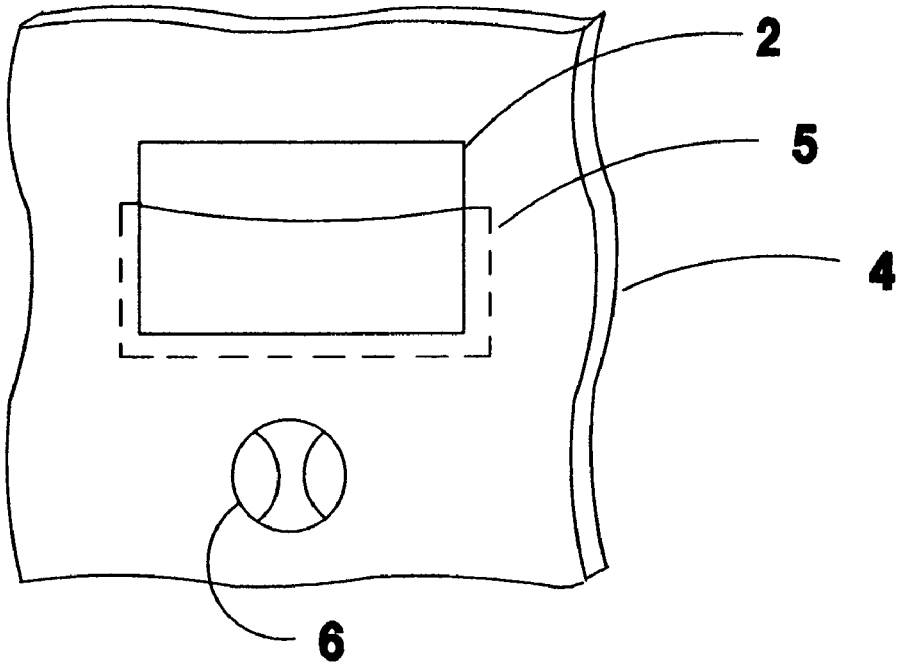
FIG. 3 The slip-on embodiment of the invention using fabric

Referring to FIG. 3, a sheath or bag-like structure 4 is adapted to fit over the back of a chair or arena seat 9. The back of the sheath is a back panel 11 which has a window opening 2 covered by a placard protecting transparent panel. A panel of clear plastic is preferred, but a screen or mesh panel will suffice for use in some venues. A second, interior panel 5 is installed behind the window panel. The bottom and sides are closed to form a pocket to receive an informational placard. The pocket panel is shown as extending over almost all of the window. Because the placard will be supported by the seat back, the pocket may be much smaller, just covering a portion of the lower area of the window. Just enough to keep the placard from shifting or falling out of place.

The bag-like sheath is preferably constructed of flexible materials such as cloth, flexible plastic, or the like.

The areas around the perimeter of the window, the side panels, and the front side may be emblazoned with permanent inscription.

The chair shown in FIG. 2 has a significant thickness, Thus a portion of the sheath 4 requires side and top panels 10 which may be distinct parts as illustrated. When the chair back is comprised of thinner material, the panels may be merely the small portions of the front and back panels that are turned around the seat-back edge. The large panels shown may be separate pieces, have separate properties such as being elastic, or may also be extensions of the front and back panels.

Figure 1:
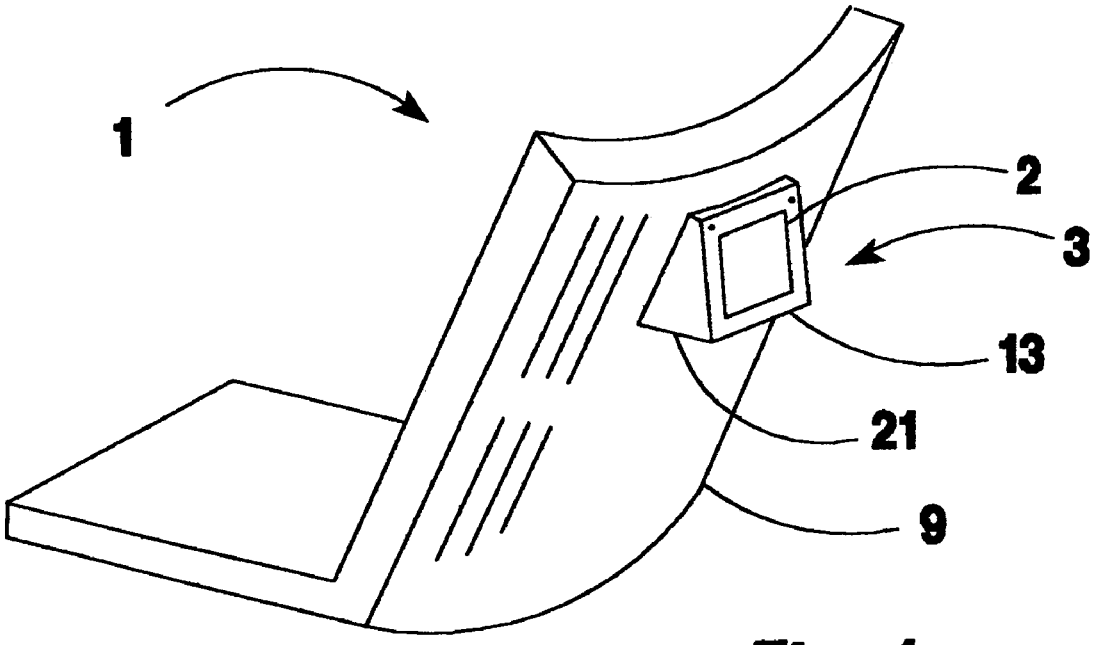
FIG. 1 A seat with the slip-on embodiment of the invention installed
Figure 6:
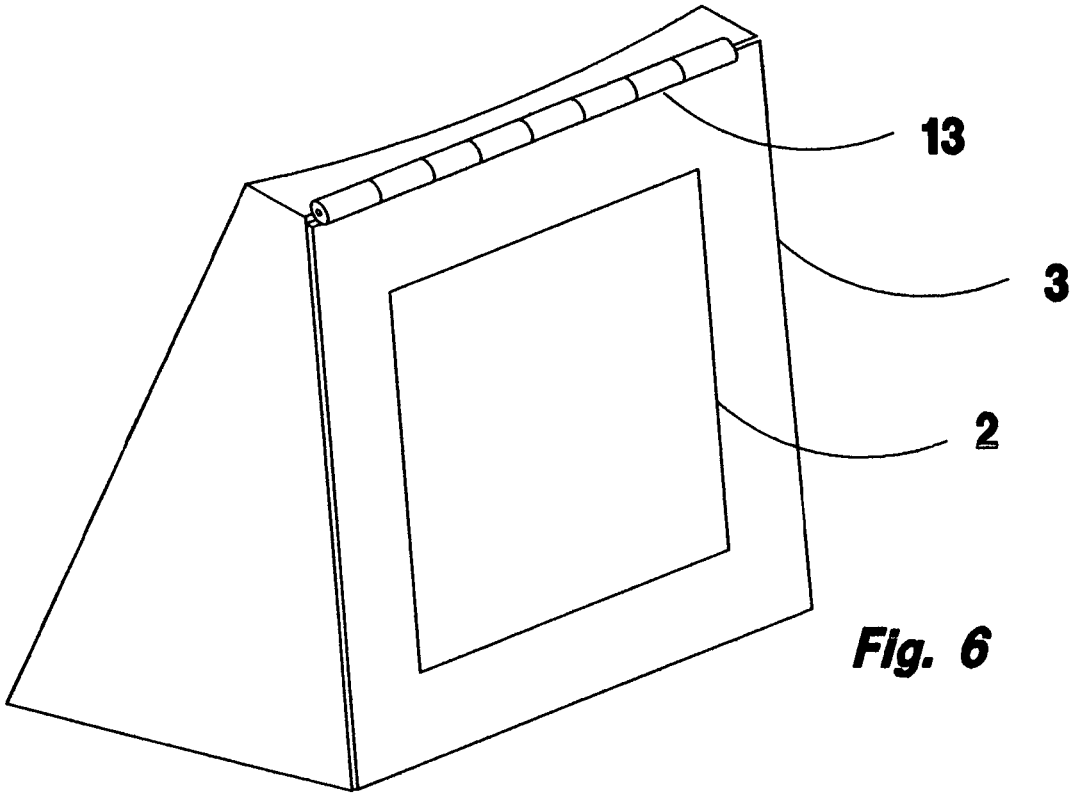
FIG. 6 Details of the tilted embodiment
Figure 7:
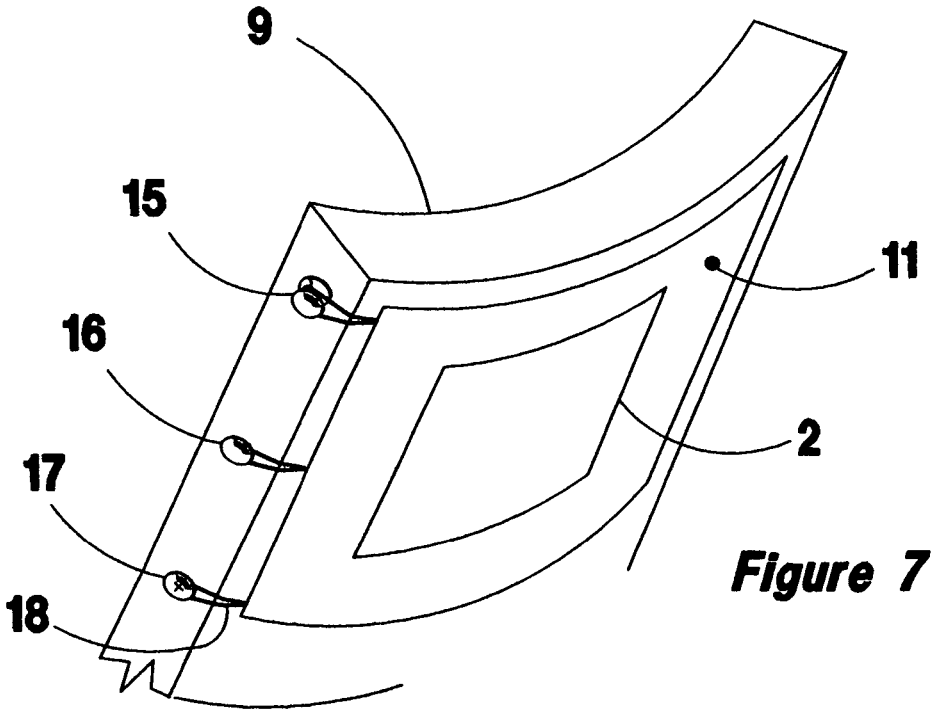
FIG. 7 Shows alternative ways of attaching the display panel assembly to a seat.

The embodiment shown in FIGS. 2 and 7 are flat against the seat back. Since many theater and arena seats have tilted-back seat backs and are mounted on rising floors, the placard inclosed in the present invention will be viewed at an oblique angle, which may be significant with some seat designs. FIGS. 1 and 6 show a variation of the present embodiment where the placard holder 3 is a box-like bracket 21 structure with an upwardly facing viewing front to overcome the effects of the tilted seat back. Bracket front panel 14 may be hinged 13 along one side to permit opening for access to the placard holding pocket inside. Locking Hold-down fasteners 20 secure the placard holding panel to the mounting bracket 21. The bracket 21 may be fixed to the seat back or may be attached to a hard base panel shaped to conform the curvature of the seat-back. It is not necessary that the box 21 be closed on all 6 sides. Spring loading may be included so that the box collapses against the chair back when bumped by people passing along the row of seats.

The display panel is locked in place by one or more locking devices 20 such as a cam lock or threaded fastener having a turning means that is not likely to be operated by whatever tools are likely to be in the pocket of a sports fan, especially pocket knives, small screwdrivers, keys, nail clippers and the like. The turning means may be recessed hex (Allen) head, 3 winged recessed drive, spline drives, or unique 5 or 7 sided recessed heads, etc. Recessing blocks access to larger items such as keys and most knife blades. 3 wing drives in particular do not offer purchase to a simple flat blade screwdriver. Hex heads and splines can be turned by a common screwdriver of appropriate dimensions to fit snugly within the recess.

Figure 4:
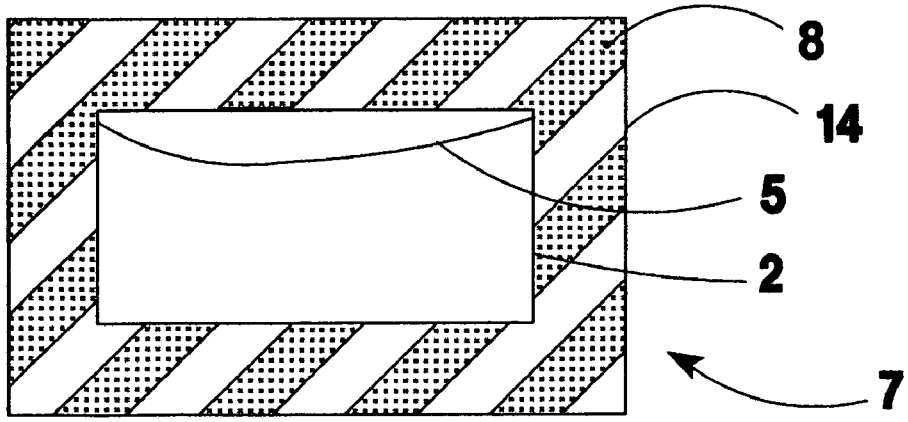
FIG. 4 Front side of a panel embodiment of the invention
Figure 5:
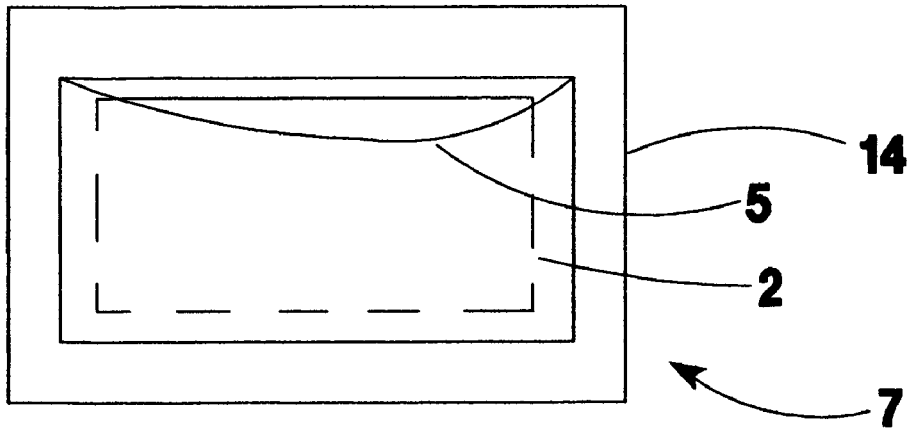
FIG. 5 View of the obverse side of the embodiment shown in FIG. 4

FIGS. 4 and 5 illustrate a universal placard holder 7 comprising a flat, usually flexible, carrier sheet 14 with a transparent window 2 and a pocket-forming sheet 5 on the reverse side. The pocket is constructed by joining three adjacent edges 19 of sheet 5 to the back side of windowed panel 14, preferably by welding or glueing. In FIG. 4, the front side of 14 is illustrated with peripheral markings 8. The markings 8 shown in FIG. 4 are renditions of the yellow and black diagonal striping used on warning signs. Other patterns or specific markings more suitable to the intended venue may be used instead. In the embodiment illustrated in FIGS. 4 and 5, carrier sheet 14 will usually be sheet magnet material, but may be adhesive backed, or attached to the display surface with pins, nails, screws, or other fastening devices.

ALTERNATIVE EMBODIMENTS AND OTHER VARIATIONS OF THE INVENTION

The side panels 10 of FIG. 2 may be replaced with hooks or hook-like structures attached to the back panel 11 and hooking around, onto, or into the side edges of the seat. Elastic bands or an elastic back panel would supply the force to keep the hooks in place.

Instead of hooks, the placard holding panel may be held in place by loops of cord or fabric 18 over bollards 15, under buttons 16, or screw heads 17 attached to chair sides 10 or even the back of chair 9, wherever they may be unobtrusive to the occupant and others in the venue. These are illustrated in FIG. 7.

Screws should be intrepreted broadly to include ¼ and ½ turn fasteners and friction-retained fasteners.

The characteristics in common between buttons, screws, and bollards is that the cord passes around and is held by a shaft, and accidental release is prevented by an enlarged head portion.

Hook-and-loop fasteners (Velcro) or snaps will perform the fastening operation in an equivalent way.

Loop cords 18 or the fabric of the panel itself are elastic to provide the tension to hold the panel snugly against the seat back.

For chair backs having a significant curvature, the seat-side of the bag embodiment 4 can be a firm panel curved to fit the seat back. This eliminates the cloth panel stretched across the chord of the seat back arc. Similarly, the box embodiment 3 shown in FIG. 1 may be attached to a similar hard, form-fitting back panel.

The hinge 13 described above for the embodiment illustrated in FIG. 6 may be replaced by any practical means of removably holding the display panel to the body of the box. Suggested are pins or tabs and co-operating holes, folded lip over the edge, and additional locks of the type already described. The principal advantages of using alternative "hinging" is possibly lower cost to construct and that the display panel may be removed to a shop for refurbishing such as for fixing damage, repainting, re-logoing, or even reloading the message placard holder.

How to Use the Invention

The bag like embodiment shown in FIG. 2 is constructed to co-operatively fit over the back of a chair. Because the subject chairs are constructed in various dimensions, the dimensions of the bag may be customized to fit the target chair. In use, the informational placard is placed within the internal pocket and the placard holding bag is slipped over the chair back. To change the placard inside, it is usual to remove the bag, remove the old placard, and insert the new placard, then re-slip the bag onto the chair. Similarly, the box structure of FIG. 1 is opened with the cooperating tool and the placard replaced.

The magnetic embodiment of FIGS. 4 & 5 is intended primarily for use on metal seat backs and on machinery, etc. Not all venues for gathering have participants with time on their hands or inclination to vandalize the facilities, thus a simpler version of the placard holder is a viable optional embodiment.

We claim:

1. An information presentation system comprising:

a. a first panel having a viewing window and front and back surfaces, and b. a second panel fixedly attached to the back surface of said first panel along three contiguous edges of said second panel, thereby forming a pocket adapted to receive an information placard therein for viewing through said window, and c. a mounting bracket to interface between the first panel and the back of a chair, the bracket being adapted to tilt said first panel containing a received information placard upwardly toward a reader seated behind said chair, and d. attachment means to removably attach said first panel to said mounting bracket, whereby said first panel may be re-oriented to expose said placard receiving pocket for inserting an information placard.

2. The information presentation system of claim 1 further comprising a hinge between said first panel and said mounting bracket, whereby said first panel may be rotated to present said placard receiving pocket is made accessible for loading with said information placard.

3. The information presentation system of claim 1 where said attachment means comprising at least one tamper resistant fastener.

4. The information presentation system of claim 1 further comprising at least one hinge between said first panel and said mounting bracket.

5. An information presentation system comprising:

a. a first panel comprising flexible magnetic material having front and back surfaces and an aperture approximately centered in the panel, where the edges of said aperture and the edges of said first panel define contiguous magnetic surfaces surrounding said aperture; and b. a second flexible panel fixedly attached to the back surface of said first panel along three adjacent edges of said second panel, and traversing said aperture, thereby forming a pocket having one open side and being adapted to receive a placard containing information for display through said aperture, and whereby said information placard is removably attached to the combination of first and second panels; and c. said first panel entirely surrounding said aperture comprising contiguous magnet means to provide magnetic forces for removably securing said presentation system to a magnetically cooperative mounting surface, where the information placard is held between the magnetic sheet and the cooperating mounting surface.

6. The information presentation system of claim 5 further comprising diagonally oriented, striped markings of alternating contrasting colors on said front surface of the magnetic material surrounding said aperture.

7. An information presentation system comprising:

a. a first substantially rectangular panel comprising flexible magnetic material having front and back surfaces and a substantially rectangular aperture approximately centered within the panel, where the edges of said aperture and the edges of said first panel defining four areas of surface surrounding said aperture; and b. a second flexible panel fixedly attached to the back surface of said first panel and traversing said aperture, and said attachment between said first and second panel is substantially along three adjacent edges of said second panel and adjacent portions of said aperture surrounding surfaces of said first panel, thereby forming a pocket having one open side and being adapted to receive a placard containing information for display through said aperture, and whereby said information placard is removably attached to the combination of first and second panels; and c. said front surface of the first panel further comprising diagonally oriented, striped markings of alternating contrasting colors on said front surface of the magnetic material surrounding said aperture, d. said first panel entirely surrounding said aperture comprising magnet means to provide magnetic forces for removably securing said presentation system to a magnetically cooperative mounting surface.

8. An information presentation system comprising:

a. a first panel comprising flexible magnetic sheeting having front and back surfaces and an aperture approximately centered in the panel, where the edges of said aperture and the peripheral edges of said first panel define contiguous magnetic surfaces surrounding said aperture; and b. a holding means to hold an information displaying placard against the back surface of said first panel where the information is viewed through said aperture in the first panel, and where the holding means comprising a second panel spanning said aperture and fixedly attached to the back surface of said first panel in the vicinity of said aperture, and;

c. said first panel entirely surrounding said aperture comprising contiguous magnet means to provide magnetic forces for removably securing said presentation system to a magnetically cooperative mounting surface.

9. The information presentation system of claim 8 further comprising diagonally oriented, striped markings of alternating contrasting colors on said front surface of the magnetic material surrounding said aperture.

* * * * *